US007065865B2

(12) United States Patent
Simard

(10) Patent No.: US 7,065,865 B2
(45) Date of Patent: Jun. 27, 2006

(54) TRUSS ASSEMBLY APPARATUS WITH ENDLESS TRACK SYSTEM

(76) Inventor: Ghislain Simard, c/o GI-MAR Inc., 1255, 2e Rue Parc Industrriel, Sainte-Marie-de-Beauce, Quebec (CA) G6E 1G7

( * ) Notice: Subject to any disclaimer, the term of this patent is extended or adjusted under 35 U.S.C. 154(b) by 338 days.

(21) Appl. No.: 10/608,728

(22) Filed: Jun. 27, 2003

(65) Prior Publication Data

US 2004/0006868 A1 Jan. 15, 2004

(30) Foreign Application Priority Data

Jul. 15, 2002 (CA) ..... 2393304

(51) Int. Cl.
*B23P 19/00* (2006.01)

(52) U.S. Cl. ..... 29/791; 29/799; 29/897.31; 29/798; 100/210; 100/913

(58) Field of Classification Search ..... 29/791, 29/799, 238, 281.5, 281.6, 897.31, 772, 798; 100/210, 913, 100; 269/910
See application file for complete search history.

(56) References Cited

U.S. PATENT DOCUMENTS

| | | | | |
|---|---|---|---|---|
| 3,538,843 A | * | 11/1970 | Lubin | 100/353 |
| 3,667,379 A | | 6/1972 | Templin | |
| 3,925,870 A | | 12/1975 | Adams | |
| 4,084,498 A | | 4/1978 | Weaver | |
| 4,295,269 A | | 10/1981 | Wright | |
| 4,437,234 A | | 3/1984 | Thornton | |
| 5,048,409 A | | 9/1991 | Schulz | |
| 5,211,108 A | | 5/1993 | Gore et al. | |
| 5,933,957 A | * | 8/1999 | Haase | 29/897.31 |
| 5,933,958 A | | 8/1999 | Shamblin | |

FOREIGN PATENT DOCUMENTS

| | | |
|---|---|---|
| CA | 2 283 106 | 10/2001 |
| CA | 2249 920 | 4/2003 |

OTHER PUBLICATIONS

MiTek RoofGlider—Trackless Roof Truss Roller System—Version 1.
MiTek RoofGlider—Trackless Roof Truss Roller System—Version 2.

(Continued)

*Primary Examiner*—Marc Jimenez
*Assistant Examiner*—Christopher M. Koehler
(74) *Attorney, Agent, or Firm*—Schweitzer Cornman Gross & Bondell LLP

(57) ABSTRACT

A truss assembly apparatus for assembling truss structures, by assembly on two or more consecutive, spaced apart, coplanar work table surfaces and with a gantry type press assembly of a plurality of wooden truss members and truss connector plates with toothed projections, the truss members coupled by embedding the connector plate projections into said truss members. The truss assembly apparatus has a gantry type press assembly with first and second ends adapted to be mounted on first and second ends of each of said work table surfaces, for movement over the work table surfaces and the space between adjacent work table surfaces. The gantry assembly has a continuous belt on the first and second ends for driving of the gantry assembly, by engagement of the continuous driving belt with the first and second table ends. The gantry assembly is configured to be supported by the continuous belt, during movement of the gantry over a work table surface when crossing the space between work table surfaces.

10 Claims, 7 Drawing Sheets

OTHER PUBLICATIONS

Alpine Engineered Products, Inc.—Roll-A-Master.
Pacific Automation Ltd.—J-Slot Table System.
Alpine Engineered Products, Inc.—Trusset Jigging System—brochure.
Alpine Engineered Products, Inc.—advertisement.
Commercial Machinery Fabricators Inc.—advertisement.
Tee-Lok—brochure.
Alpine—advertisement.
Robbins Engineering, Inc.—No-Rail Gantry With Walkthrough Aisles—brochure—Oct. 1999.
Robbins Engineering, Inc.—No-Rail Gantry With Walkthrough Aisles—brochure—Mar. 2000.
MiTek—RoofGlider—Trackless Floor Truss Roller System—brochure.
MiTek—Trackless Floor Trust Roller System—brochure.

* cited by examiner

TRUSS ASSEMBLY APPARATUS WITH ENDLESS TRACK SYSTEM

FIELD OF THE INVENTION

The present invention relates generally to an apparatus for the manufacture of structural truss components. More particularly, the present invention relates to a roller type gantry press machine for assembling pre-cut truss members, and to methods for assembling pre-cut truss members utilizing such apparatus.

BACKGROUND OF THE INVENTION

The use of gantry presses is now common for the manufacture of prefabricated truss structures. The remote prefabrication of truss structures, including roof and floor trusses, for later transport to the job site for assembly into a building or other structure under construction is a well known practice which, due to greater efficiency, provides a significant time and labour requirement savings compared to job site assembly.

As will be understood by the skilled person, the remoter prefabrication of truss structures includes the assembly of truss members, such as chord and other web members, on a truss assembly table. The truss members have generally top and bottom surfaces and the truss members are laid out on the work surface of the truss assembly table, typically in a predetermined pattern or arrangement, according to the size and shape of the truss assembly desired to be prefabricated. The truss members are coupled by connector plates with toothed or nail-like protrusions, the connector plate protrusion being on one side of the plate. In assembly of the truss members into the desired truss assembly, size and shape, the connector plates are positioned where truss members abut, so the protrusions may be embedded in the truss members.

A gantry type press machine is typically used to imbed the connector plates into the truss members, to manufacture the truss assembly. Connector plates will typically be embedded in first one surface of the members of the truss assembly, the truss assembly then flipped on the surface of the truss assembly table, and connector plates imbedded in the other surface of the truss assembly.

Typically, a truss assembly manufacturing facility includes a truss assembly table and a gantry type press machine, such as a press roller, which moves relative to the work surfaces of the truss assembly table, the press roller applying pressure to imbed connector plates into the truss members.

The length of required work surface of a truss assembly table will vary with the length of truss assembly to be fabricated.

For a shorter truss assembly, a single assembly table may be used. For a longer truss assembly, it is typical to use a single long truss assembly table, with regular spaces along the length of the table to define sections of the table, or a line of tables in a row with spaces between the tables, arranged to permit access to worker between tables or table sections, to permit easier access to workers to the work surface of the assembly table, for handling of the truss members, connector plates and the assembled truss.

Various types of truss assembly gantries and like apparatus are well known in the art, for assembly of truss structures remote from the job site and for use in methods of such assembly.

U.S. Pat. No. 3,667,379 and U.S. Pat. No. 3,925,870 are examples of apparatuses for the two-step penetration and installation of truss plates onto wooden truss elements, with a fixed pressing station and the truss elements assembled on a moving table or surface.

U.S. Pat. No. 4,295,269 and U.S. Pat. No. 4,437,234 are examples of truss assembly machines wherein the press roller is mounted on a moveable presser carriage, coupled and supported by the truss assembly table for reciprocating movement. In such assemblies, the presser carriage, moves by rolling contact between the press roller itself and a table member, such as a rail extending the length of the table. The press roller, by direct contact with the table rail moves along the length of the table functioning to press connector plates into the joints of truss elements positioned on the table. Rotating bearings coupled to the present carriage engage a side beam extending the length of the table, to constrain lateral and upward movement of the presser carriage.

Another known design of truss assembly apparatus is where the gantry carriage straddles the work table, moving along the work surface, supported on rails secured to the floor of the work area containing the truss assembly apparatus. Such rails are positioned adjacent and parallel to either side of the truss assembly table, for movement and support of the truss assembly gantry or like apparatus along the length of the truss assembly table work surface. Examples of the above type of truss assembly apparatus may be found in U.S. Pat. No. 5,933,958, U.S. Pat. No. 4,084,498, U.S. Pat. No. 5,048,409 and U.S. Pat. No. 5,211,108.

The above mentioned truss assemblies all exhibit certain drawbacks for the manufacture of pre-fabricated trusses. The assembly of trusses of larger dimension and of certain configurations may be more complex where truss assembly apparatuses with a moving table are used. As well, a truss assembly apparatus with a fixed floor rail for support of the truss assembly gantry may pose a tripping hazard to assembly workers attempting to access the surface of the truss assembly table.

Press roller assemblies without floor rails, such as those described in U.S. Pat. No. 4,295,269 or U.S. Pat. No. 4,437,234 still restrict access to the surface of the work table.

More recently, as truss assembly tables and work surfaces have become wider and longer for the purpose of assembling trusses of larger dimension, and otherwise generally to facilitate worker access to the truss members and truss connector plates, truss assembly apparatuses have been designed with regular spaces in the truss table work surface or with separate tables spaced by being positioned in a line as described above, allowing access to the worker to the spaces there between. Truss assemblies where the gantry is mounted on a floor rail system will again impede access by the worker to the spaces between sections of the working surface of the truss assembly table. Likewise, truss assembly designs with spaced work surfaces and table mounted rails for support and reciprocating movement of the press gantry across the spaces adjacent work surfaces will impede worker access to the spaces between work surface sections.

Table mounted rail assemblies typically include wheel or bearing assemblies rotatably mounted to the gantry assembly, for reciprocating movement of the gantry assembly along the table work surfaces. Such designs have the drawback of limiting the points of contact between the gantry assembly and the table mounted rails to permit the gantry assembly to traverse the space between work surfaces by engaging only one of the work table surfaces.

Additionally, table mounted wheel or bearing gantry assemblies will result in greater machinery vibration being transferred to the work surface, as compared to floor rail mounted gantry assemblies, making more difficult the proper assembly of truss elements and connector plates.

Additionally, truss assemblies with table mounted rails will require means to constrain lateral and upward movement of the gantry assembly relative to the rails and work surface. Typically, this may be by a bearing or wheel assembly, rotatably mounted on the gantry assembly. In an emergency where very quick stoppage of the apparatus is required, because of the rotating bearings, such assemblies may not be able to stop swiftly enough due to momentum of the apparatus, thereby still posing a safety hazard to the worker.

Accordingly, there is a requirement for a gantry type truss assembly apparatus without floor rails for mounting and movement of the truss assembly gantry. For truss assembly table designs with spacing between work sections, there is also a requirement for a truss assembly apparatus which does not restrict access to the worker to the space between work sections and where the gantry may move on a table mounted rail without the rails restricting access to the spaces between table sections, to the worker. Further, there is a requirement for a table mounted rail assembly which limits machine vibrations transfer to the work surface, while permitting movement of the gantry assembly across, the space between work surfaces, supported by only one of the table work surfaces. Additionally, a gantry type truss assembly is desired with greater security in circumstances where an emergency stoppage of the relative movement of the gantry assembly to the table is required.

SUMMARY OF THE INVENTION

The aforesaid and other objects are provided by a gantry type truss assembly apparatus for pressing connector plates into truss members, the apparatus being without floor rails, with a truss work table assembly on which truss members and connector plates are assembled, with spaces between table work sections, or separate tables regularly spaced, to permit entry of workers there between for access to work table surfaces, and table mounted rails for reciprocating movement of a truss press gantry assembly along the spaced work surfaces, the truss gantry assembly including continuous driving belt means and the table including parallel rail means whereby the truss gantry assembly may move along the table rails by engagement of the continuous belt means with the table rails means. The aforesaid assembly with continuous belt means is designed without the rails traversing the spaces between table work sections, such as not to block access to said spaces. The aforesaid assembly further includes a gantry truss assembly with continuous belt means designed and configured to traverse the space between table sections, without requiring rail means bridging the space between table sections and to support the gantry truss assembly as it traverses the space between work surfaces. The gantry assembly with coupled continuous belt means is designed and configured with the truss assembly work table surfaces to be engaged with the rails means on two adjacent table work sections when traversing the space between adjacent table sections, the rail means being generally coplanar with the working surface of the truss assembly table.

The present truss assembly apparatus includes a first guide means coupled to the truss gantry assembly, to engage the continuous belt means with the table rails and a second guide means to couple the assembly tables and the truss assembly gantry apparatus, to constrain lateral and upward movement of the gantry assembly and maintain pressure on the connector plates as the press assembly is moved from a first end of the truss assembly apparatus, along the length of the work table assembly to the second end of the truss assembly apparatus.

DETAILED DESCRIPTION

Figure 1:
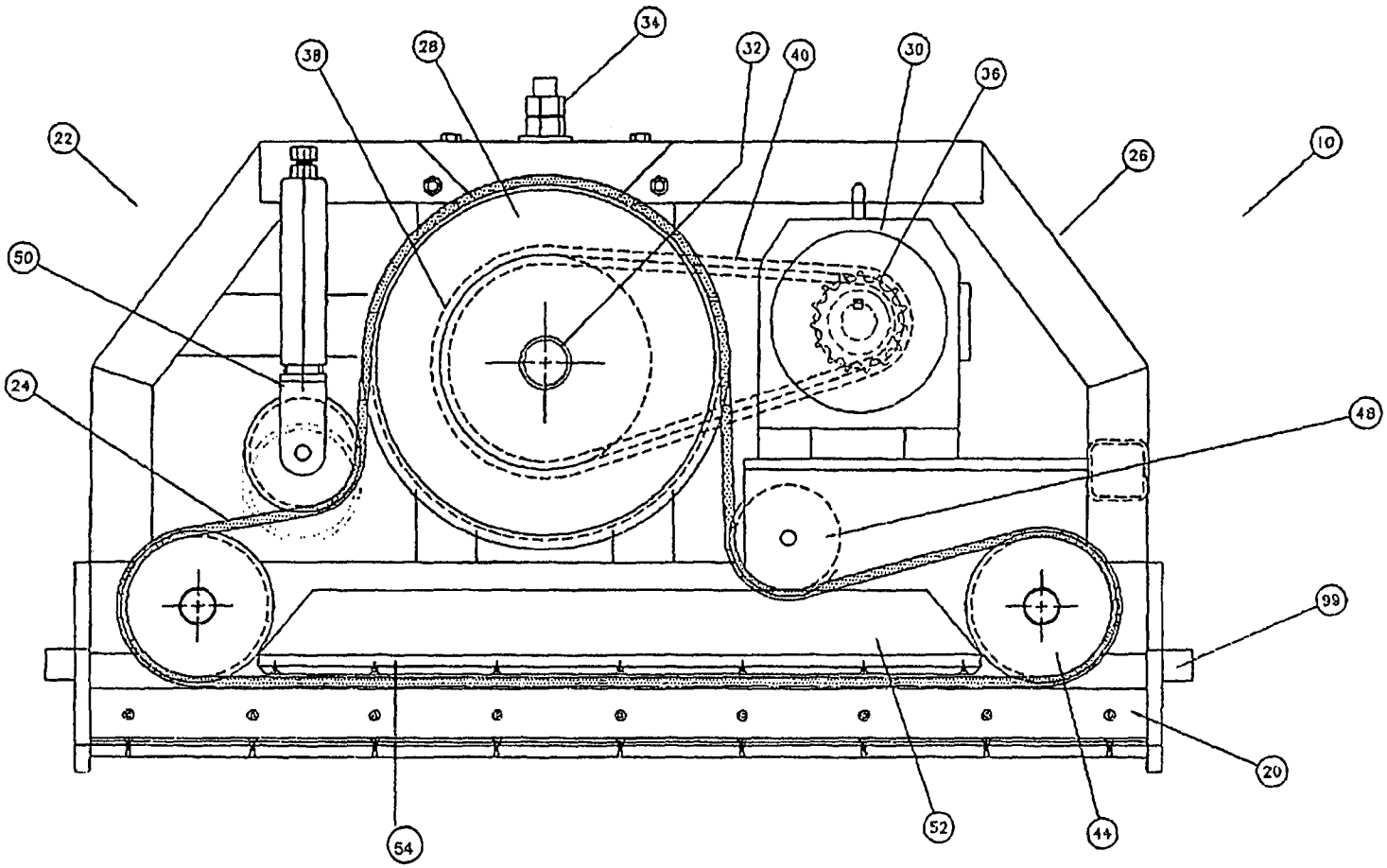
FIG. 1 is a side view of the gantry truss assembly apparatus according to one embodiment of the present invention.
Figure 3:
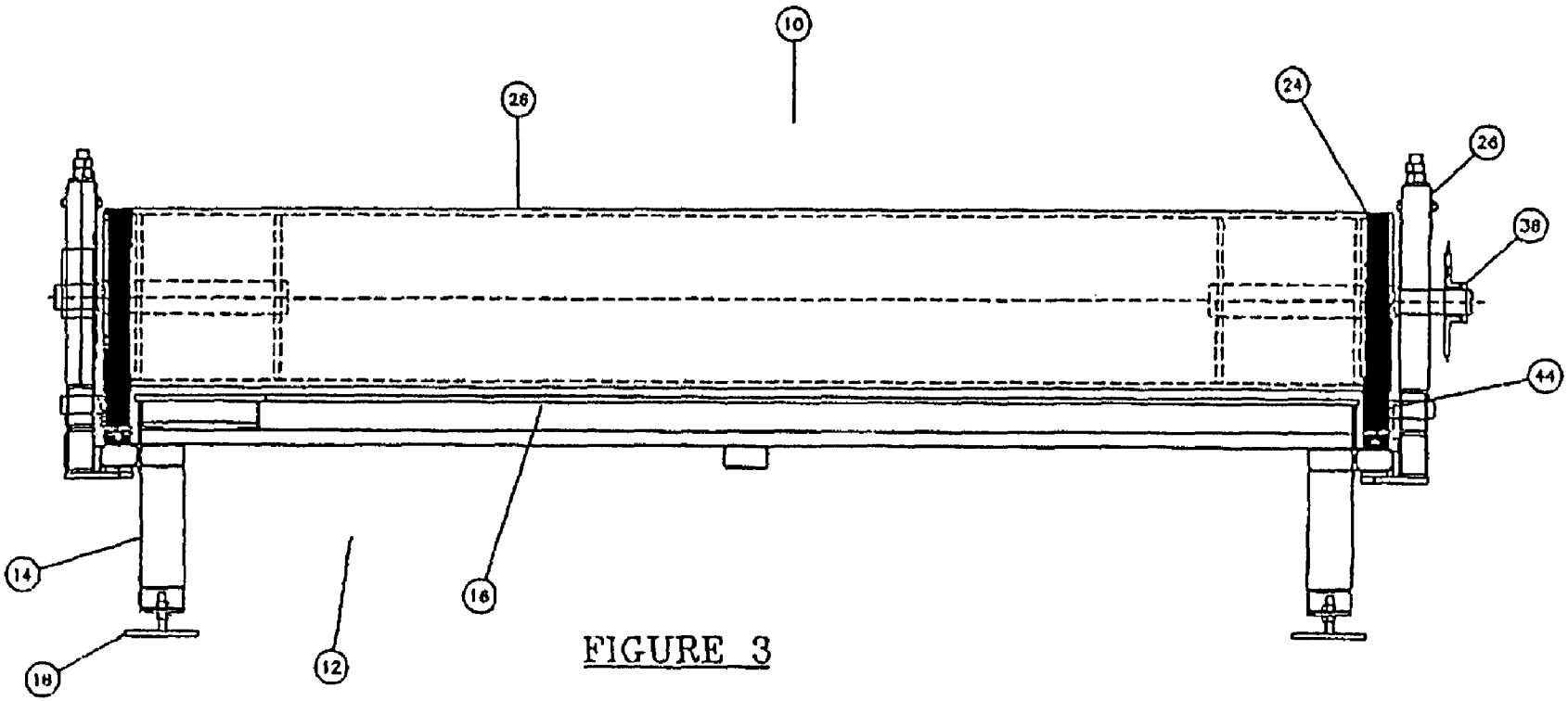
FIG. 3 is a front view of the gantry truss assembly apparatus according to one embodiment of the present invention.
Figure 4:
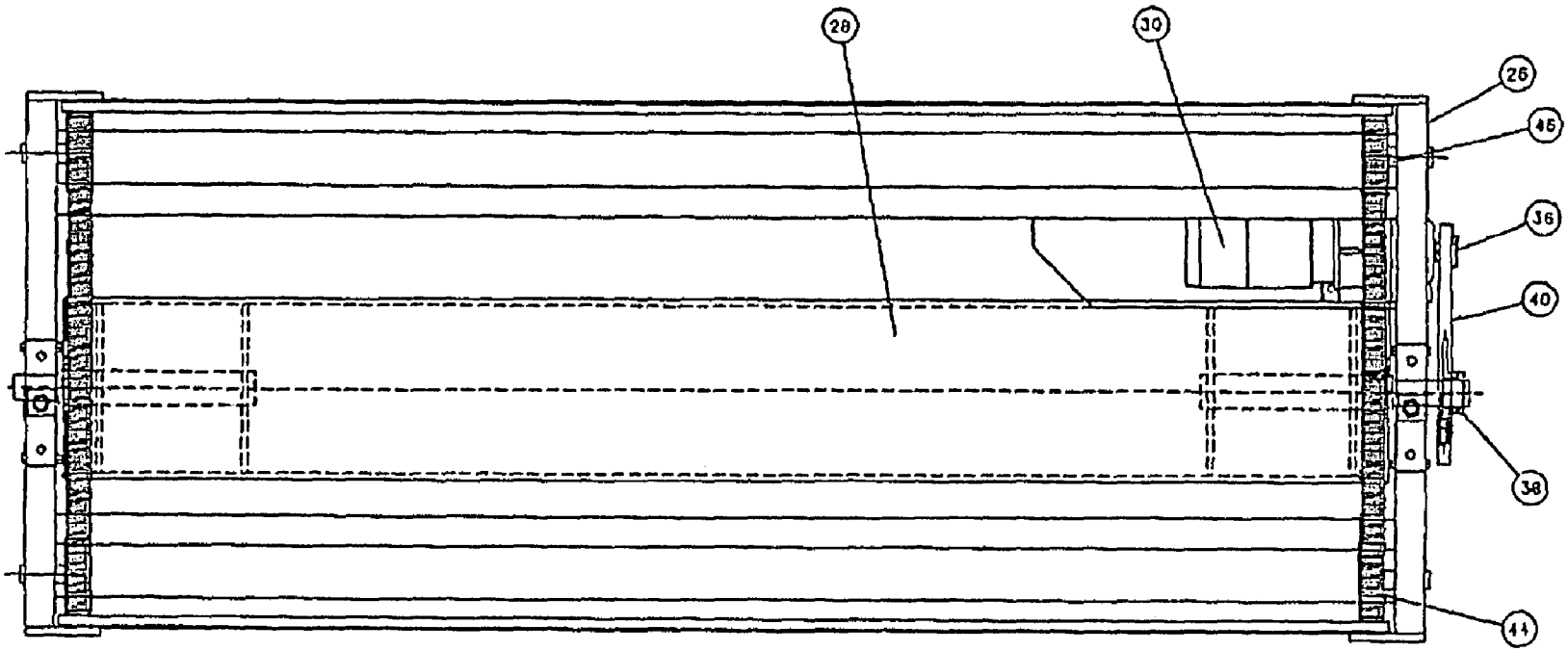
FIG. 4 is a top view of the gantry truss assembly apparatus according to one embodiment of the present invention.
Figure 5:
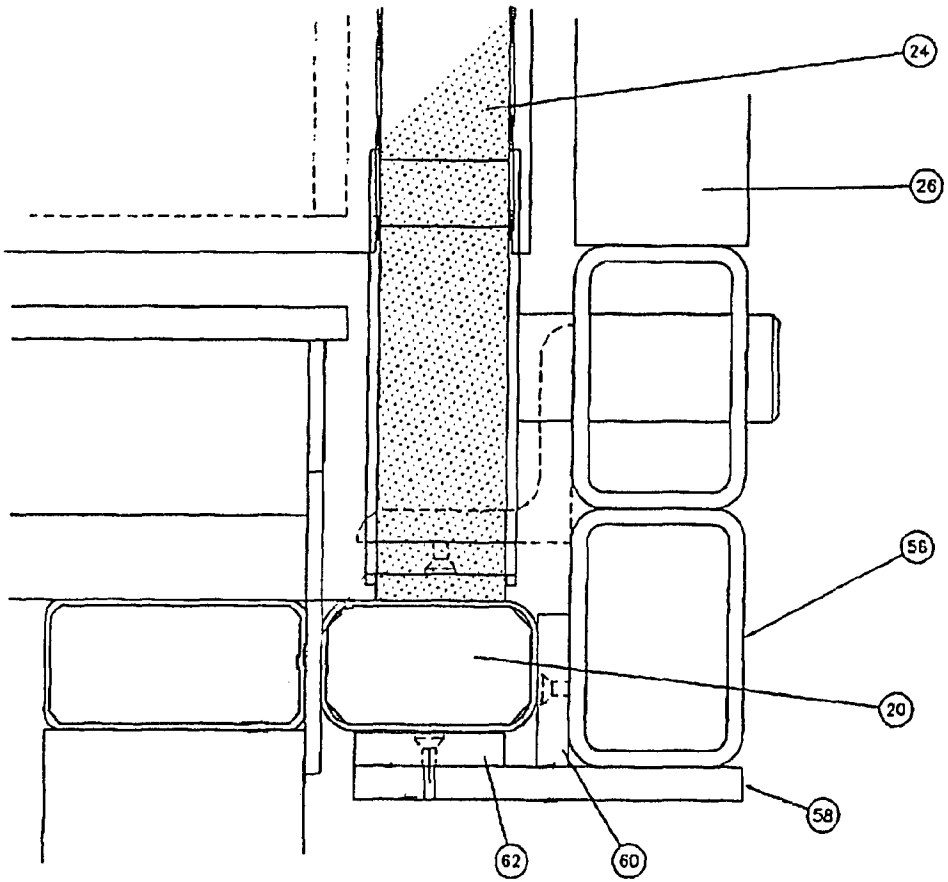
FIG. 5 is an expanded front view of the guide means engaging the gantry truss assembly with the assembly tables.
Figure 6:
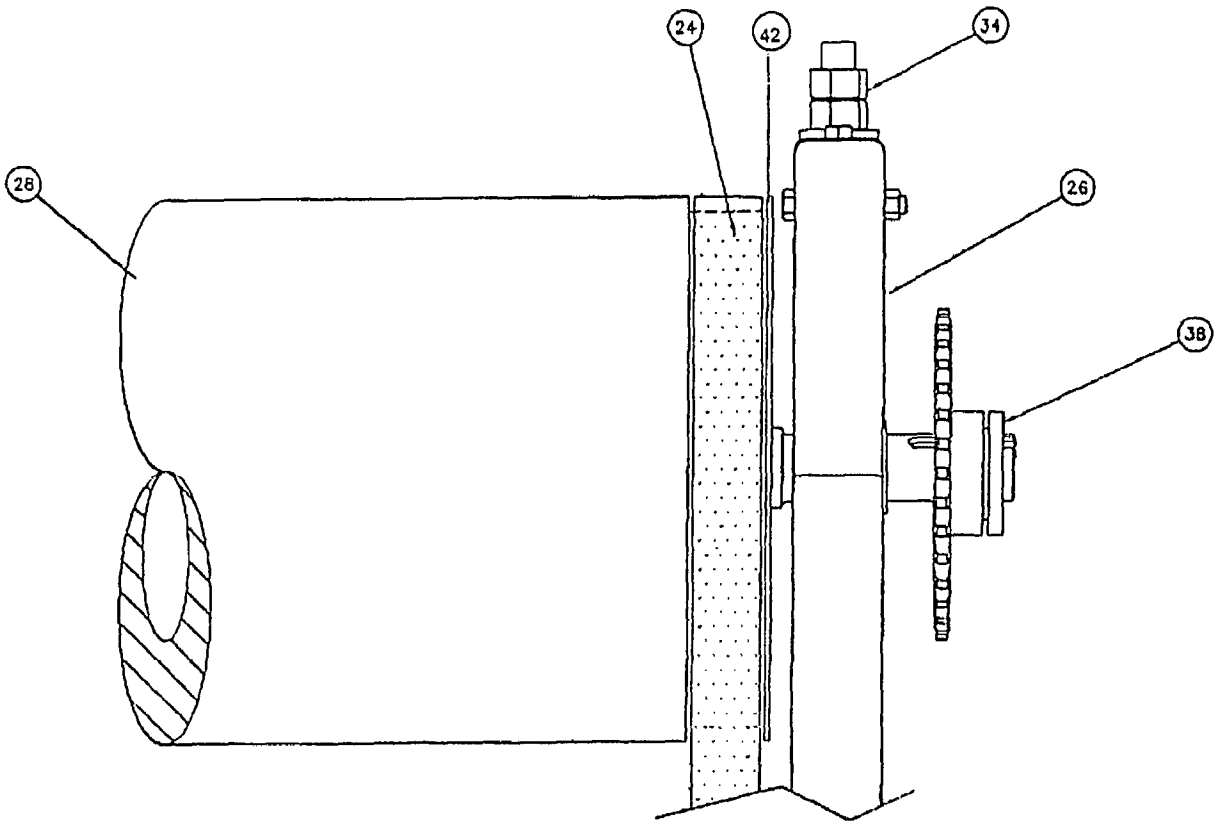
FIG. 6 is an expanded cross sectional front view of the gantry truss assembly apparatus according to one embodiment of the present invention.

FIGS. 1 and 3 are side and front views respectively of a gantry type truss assembly apparatus 10, according to one embodiment of the present invention.

Apparatus 10 of the present invention in one embodiment comprises a multi section truss assembly table 12 of spaced apart work surfaces. In another embodiment, apparatus 10 comprises a plurality of spaced truss assembly tables, wherein one such table is shown in FIG. 3. Whether of spaced apart work surfaces or tables, truss assembly table 12 is supported on legs 14 and include a truss assembly work surface 16. The truss assembly table includes a plurality of regularly positioned spaces to provide workers access to the surface of adjacent table sections. In another embodiment, the present invention comprises a series of spaced apart truss assembly tables configured in a row, with spaces of sufficient width between adjacent tables to allow easy access to the truss assembly work surface.

Table legs 14 are configured to provide adjacent table section work surfaces which are coplanar. In one embodiment, table legs 14 include adjustment means 18, which may be adjusted to provide coplanar table work surfaces. Each truss assembly table section includes track beams 20 mounted thereon, one on each side of the table. Beams 20 are configured such that they do not traverse the spaces between table sections or adjacent tables.

The apparatus of the present invention includes a gantry press assembly 22 with continuous drive track means 24 coupled thereto. Gantry press assembly 22 is sized and configured to be generally the width of the truss assembly tables. The continuous drive track means are configured to engage a rail 20 on either side of the truss assembly table and for reciprocating movement of the gantry assembly on the rails. The gantry press assembly includes support frame means 26 on both sides of the truss assembly table, a truss press roller 28 and a driving motor 30 coupled to one of the support frame means. Press roller 28 is coupled to an axel 32 configured to extend from opposing ends of press roller 28. Axel 32 is further configured to be supported by appropriate bearing means at both ends, coupled to support frame means 26. Support frame means 26 include roller adjustment means 34 for the vertical adjustment of the roller relative to the table work surface.

Motor means 30 includes a motor sprocket 36 coupled thereto and roller 28 includes roller sprocket 38 coupled to axel 32. Sprockets 36 and 38 are coupled by a motor sprocket chain means 40 which is configured to drive pressure roller 28 when motor 30 is energized and sprockets 36 and 38 are coupled by chain means 40.

Continuous drive track means 24 is coupled to roller 28, and engaged thereto, such that when motor 30 is energized, press roller 28 and the track means 24 are caused to move at a uniform speed, relative to the work surface. In one embodiment, press roll 28 includes a depression 42 sized to accommodate the width and thickness of continuous track 24, the continuous drive track being generally flush with the surface of roller 28, thereby causing the continuous track 24 to move at the same speed as press roller 28.

Figure 2:
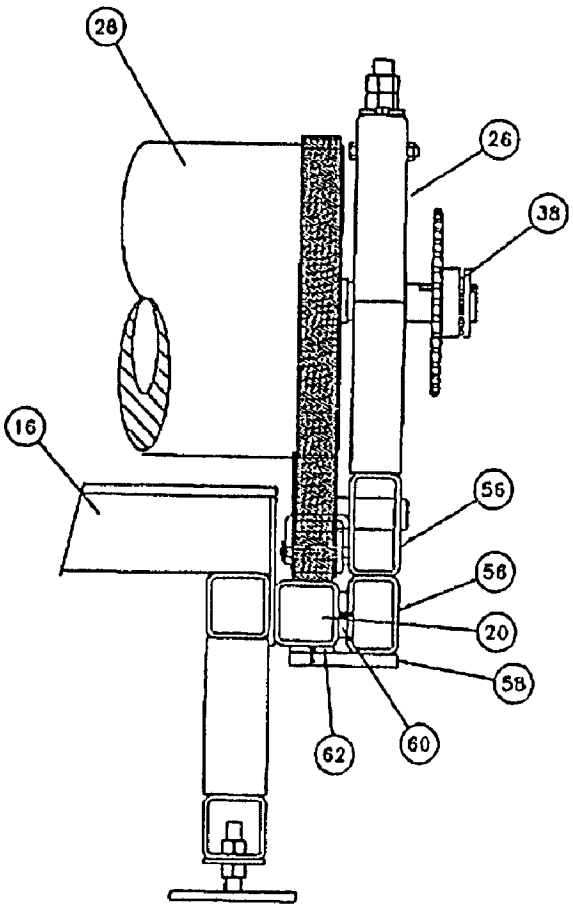
FIG. 2 is a cross sectional front view of the gantry truss assembly apparatus according to one embodiment of the present invention.
Figure 2A:
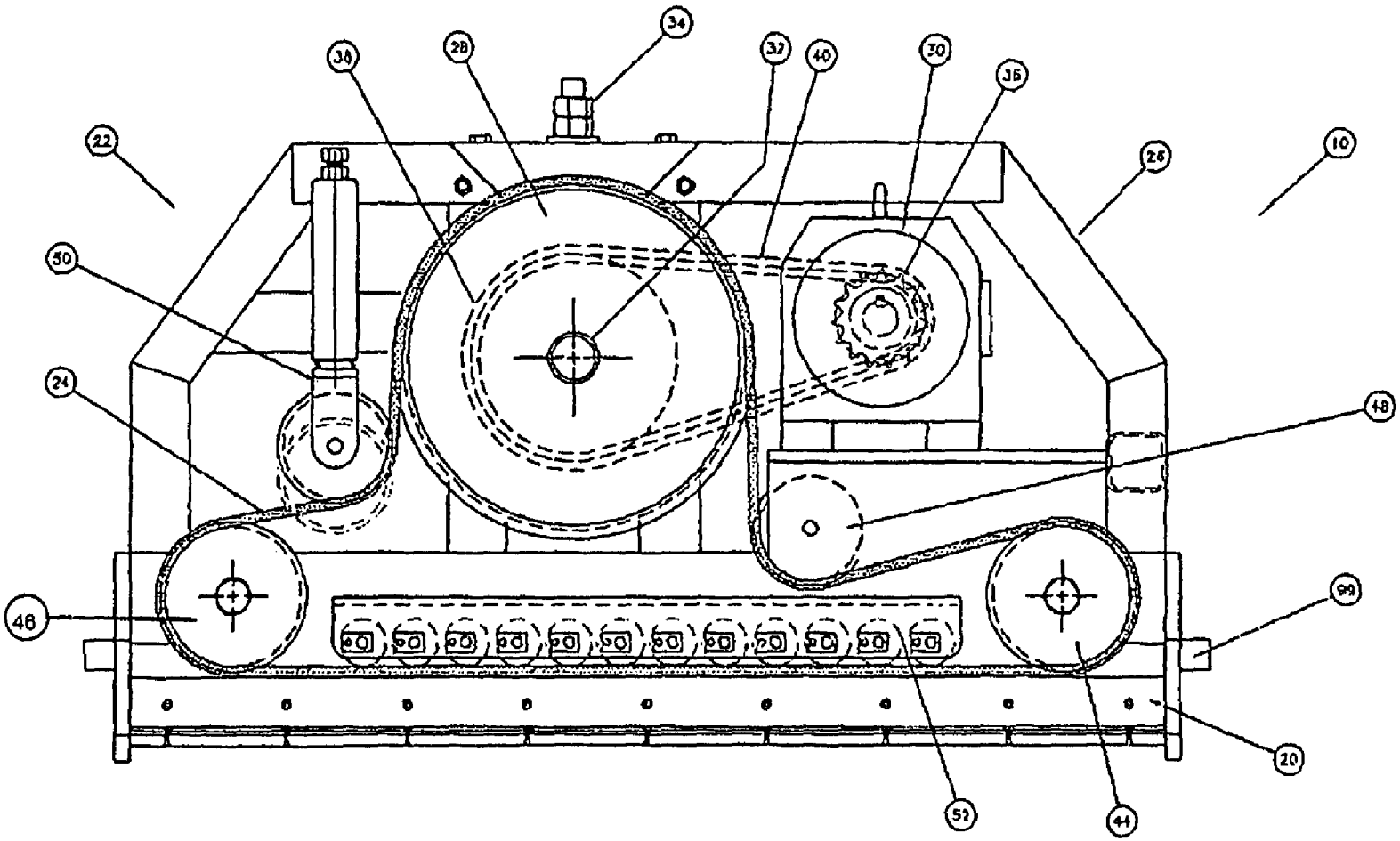
FIG. 2A is a side view of the gantry truss assembly apparatus according to a second embodiment.

Rotatably coupled to support frames 26 are continuous track wheels 44 and 46, fixed track tension wheel 48 and adjustable track tension wheel assembly 50, all aforesaid wheels configured to be engaged by and to be caused to be rotated, along with the press roller by the continuous drive track means when motor 30 is energized. A first guide means 52 extending substantially between wheels 44 and 46 is coupled to support frame 26 and is configured so that when the gantry type apparatus of the present invention is in use, continuous track means 24 is engaged with rail means 20 to cause reciprocating motion of the gantry assembly along truss assembly table 12. In one embodiment shown in FIG. 2A, the first guide means 52 is comprised of a plurality of guide wheels, rotatably coupled to the first guide means. The guide wheels are made of suitable durable material, such as coated metal or plastic. In a second embodiment shown in FIG. 1, first guide means 52 is comprised of track pad means 54. The guide pad may be made of suitable durable material, including "UHMW" plastic. It will be understood that there is a like arrangement coupled to the opposing end of gantry assembly 22 and roller 28, although the opposing end will not include a motor means, motor sprocket, roller sprocket and motor sprocket chain.

Roller 28 is generally of a cylindric shape and is manufactured of suitable rigid material, generally of metal or the like, such that during use of the truss assembly apparatus of the present invention a sufficient pressure is applied by the press roll to force the projections of a truss plate or plates fully into the truss elements assembled on the surface of a truss assembly table.

Truss assembly gantry apparatus 22 of the present invention is configured to engage and move along rail means 20 and to traverse the space between adjacent table sections without rails to bridge the aforesaid space. Continuous track wheels 44 and 46 are configured so that the distance between track wheels 44 and 46 and axel 32 is wider than the space between table sections. Wheel assemblies 44 and 46, tension wheels 48 and 50, first guide means 52 and continuous drive track means 24 are all coupled such that pressure is generally applied along the entire surface of rail means 20 in contact with continuous drive track means 24, thereby providing support of gantry assembly means 22 by the entire surface of rail means 20 which is engaged and in contact with continuous track means 24. Such configuration will generally apply more uniform and steady pressure from gantry assembly means 22 on rail means 20, as well as from press roller 28 to the truss members and plates being assembled.

Continuous track means 24 is also composed of durable material such as polymer elastamer or metal coated with polymer and may be configured to dampen transfer of machine vibration from gantry apparatus 20 to the working surface.

Gantry support frame 26 includes a guide support rail 56 coupled to second guide means 58. In one embodiment, second guide means 58 is comprised of guide pads 60 and 62 configured to slidably engage the side and bottom of rail 20 to constrain lateral and upward motion of gantry assembly 22 when in use. Pads 60 and 62 are composed of suitable durable material such as plastic, elastamer or metal to engage rail 20 in the aforesaid manner and to aid in the quick stoppage of the apparatus in an emergency situation. In one embodiment guide pads 60 and 62 are composed of UHMW plastic.

It will be understood by the skilled person that the apparatus of the present invention may include known emergency safety means such as safety bars or laser beams for the stoppage of the apparatus in an emergency situation.

While the truss assembly apparatus of the present invention has been described in detail in a particular embodiment, it will be appreciated by the skilled person that the present invention is not to be considered as limited to the exact form disclosed herein and that certain changes in detail and construction may be made therein which are otherwise still within the scope of the present invention and the spirit thereof.

The invention claimed is:

1. A truss assembly apparatus for assembling truss structures, by assembly on two or more consecutive, spaced apart, coplanar work table surfaces and with a gantry type press assembly of a plurality of wooden truss members and truss connector plates with toothed projections, the truss members coupled by embedding the connector plate projections into said truss members, said truss assembly apparatus comprising:

said gantry type press assembly with a first end and a second end adapted to be mounted on a first end and second end of each of said work table surfaces, for movement over the work table surfaces and the space between adjacent work table surfaces, said gantry assembly comprising continuous belt means on said first and second ends for driving of said gantry assembly, by engagement of said continuous driving belt with said first and second table ends and said gantry assembly configured to be supported by said continuous belt means, during movement of the gantry over a work table surface and when crossing the space between work table surfaces.

2. The truss assembly apparatus of claim 1, wherein the gantry type press assembly is a gantry roller type assembly.

3. The truss assembly apparatus of claim 2, further comprising guide pad means coupled to said first and second ends of said gantry assembly and guide rail means coupled to said first and second ends of said work tables, said guide pads configured to be engaged with said guide rail means.

4. The truss assembly apparatus of claim 1, further comprising guide pad means coupled to said first and second ends of said gantry assembly and guide rail means coupled to said first and second ends of said work tables, said guide pads configured to be engaged with said guide rail means.

5. A truss assembly apparatus for assembling truss structures, by assembly on two or more consecutive, spaced apart, coplanar work table surfaces and with a gantry type press assembly of a plurality of wooden truss members and truss connector plates with toothed projections, the truss members coupled by embedding the connector plate projections into said truss members, said truss assembly apparatus comprising:

rail means mounted on a first end and a second end of each work table surface of said two or more work table surfaces, said gantry type press assembly having a first end and second end adapted to be mounted on said first and second rail means, for movement over the work table surfaces and the space between adjacent work table surfaces, said gantry assembly comprising continuous belt means coupled to said first and second ends for driving of said gantry assembly, by engagement of said continuous driving belt means with said first and second rail means and said gantry assembly configured to be supported by said continuous belt means on engagement with said first and second rail means, during movement of the gantry over a work table surface or when crossing the space between work table surfaces.

6. The truss assembly apparatus of claim 5, wherein the gantry type press assembly is a gantry roller type assembly.

7. The truss assembly apparatus of claim 6, further comprising guide pad means coupled to said first and second ends of said gantry assembly and guide rail means coupled to said first and second ends of said work tables, said guide pads configured to be engaged with said guide rail means.

8. The truss assembly apparatus of claim 6, further comprising guide pad means coupled to said first and second ends of said gantry assembly configured to engage with said rail means.

9. The truss assembly apparatus of claim 5, further comprising guide pad means coupled to said first and second ends of said gantry assembly and guide rail means coupled to said first and second ends of said work tables, said guide pads configured to be engaged with said guide rail means.

10. The truss assembly apparatus of claim 5, further comprising guide pad means coupled to said first and second ends of said gantry assembly configured to engage with said rail means.

* * * * *